United States Patent [19]

Kogan

[11] 3,973,800

[45] Aug. 10, 1976

[54] MODULAR FURNITURE UNITS

[76] Inventor: Allan Sheldon Kogan, 5633 N. Kenmore Ave., Chicago, Ill. 60505

[22] Filed: Aug. 15, 1975

[21] Appl. No.: 604,902

[52] U.S. Cl. ..... 297/440; 297/135; 297/248

[51] Int. Cl.[2] ..... A47C 7/00

[58] Field of Search ..... 52/753 C, 754, 760; 297/248, 440, 443, 135; 108/64; 312/111

[56] References Cited

UNITED STATES PATENTS

| | | | |
|---|---|---|---|
| 2,087,574 | 7/1937 | Kaufer | 297/248 X |
| 3,171,690 | 3/1965 | Weiss | 297/44 D |
| 3,261,640 | 7/1966 | Straits | 297/135 |
| 3,545,712 | 12/1970 | Ellis | 52/754 X |

*Primary Examiner*—James C. Mitchell
*Attorney, Agent, or Firm*—Coffee and Sweeney

[57] ABSTRACT

Modular furniture units are quickly and easily assembled and/or disassembled using interconnecting hooking devices. The units are assembled from separate arm, seat and back sections and the interconnecting hooking devices are preferably of the same configuration on each piece, each of the hooking devices including a male member and female opening so that one device can be hooked into another device. In the simplest form, e.g. in a chair, no legs are needed because the arm members can support the entire structure. However, where sectional sofas or the like are constructed from the modular units and where there may be too much play between the modular units, it may be desirable to put support legs under the modular seat portions. Also, in another preferred form, the modular units can be assembled as or converted to the form of a divan or bed or the like.

11 Claims, 14 Drawing Figures

FIG. 1
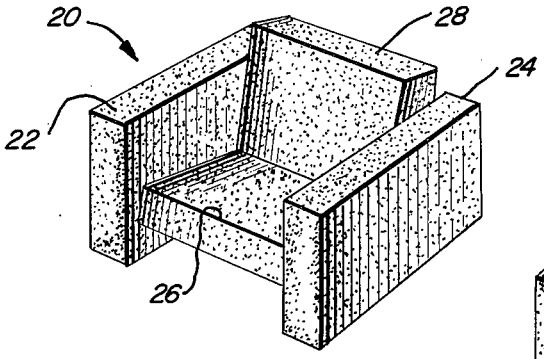
FIG. 2
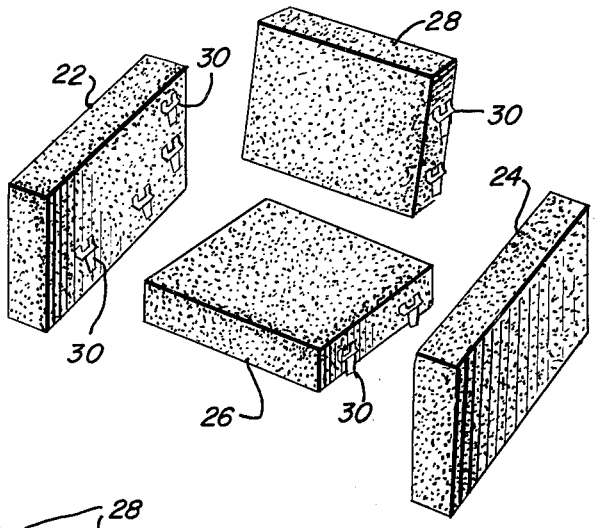
FIG. 3
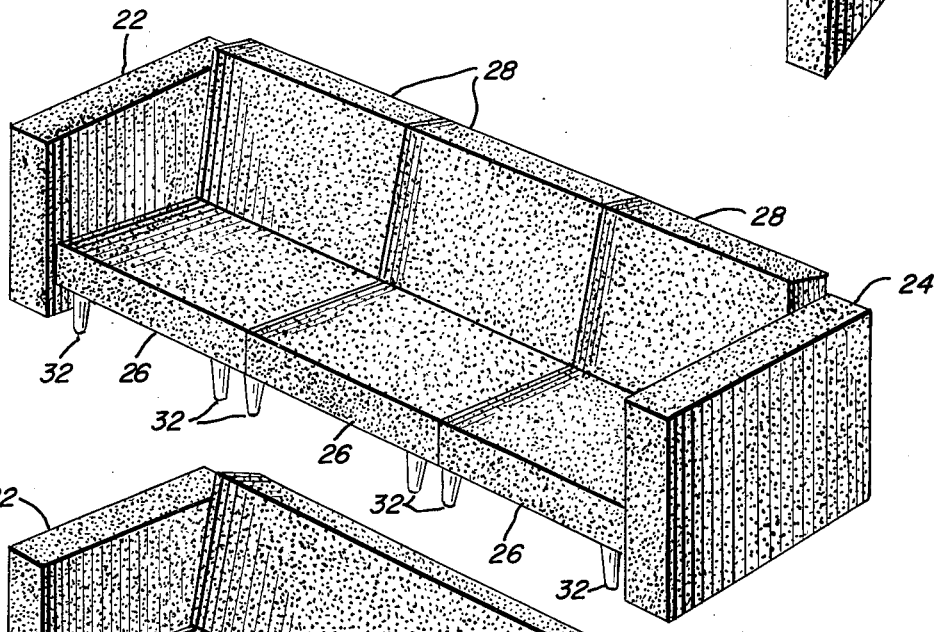
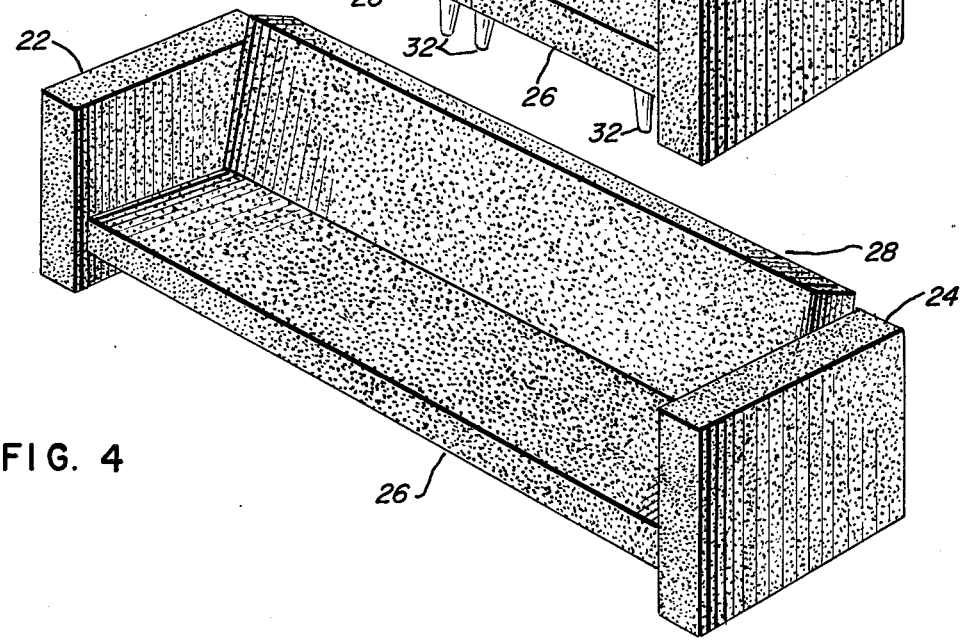
FIG. 4

FIG. 5
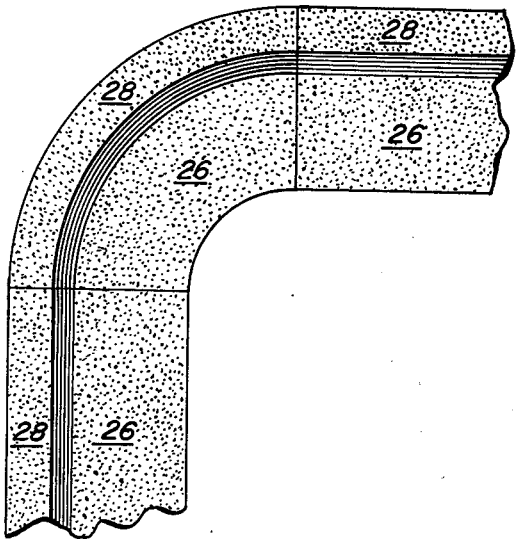
FIG. 6
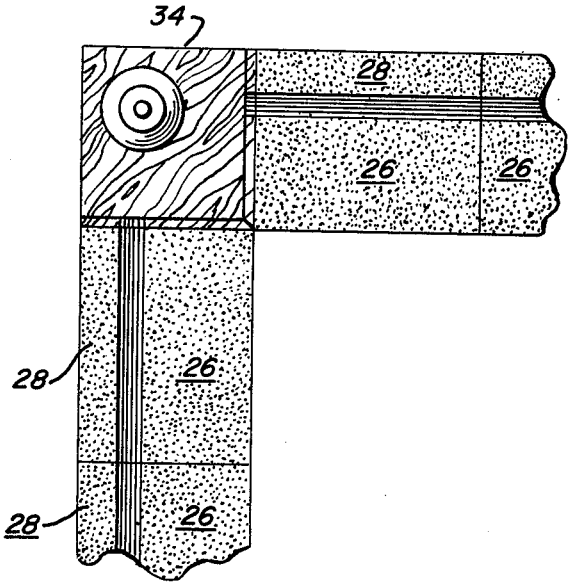
FIG. 7
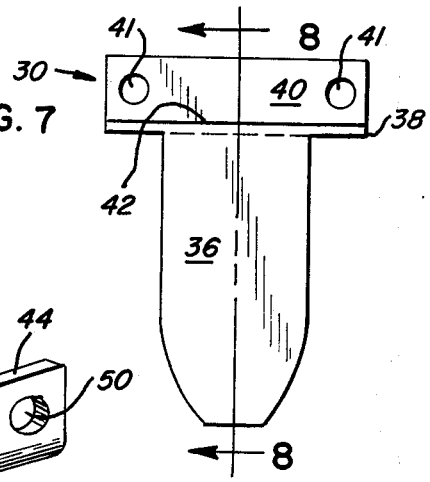
FIG. 8
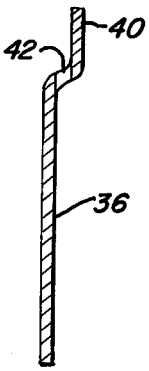
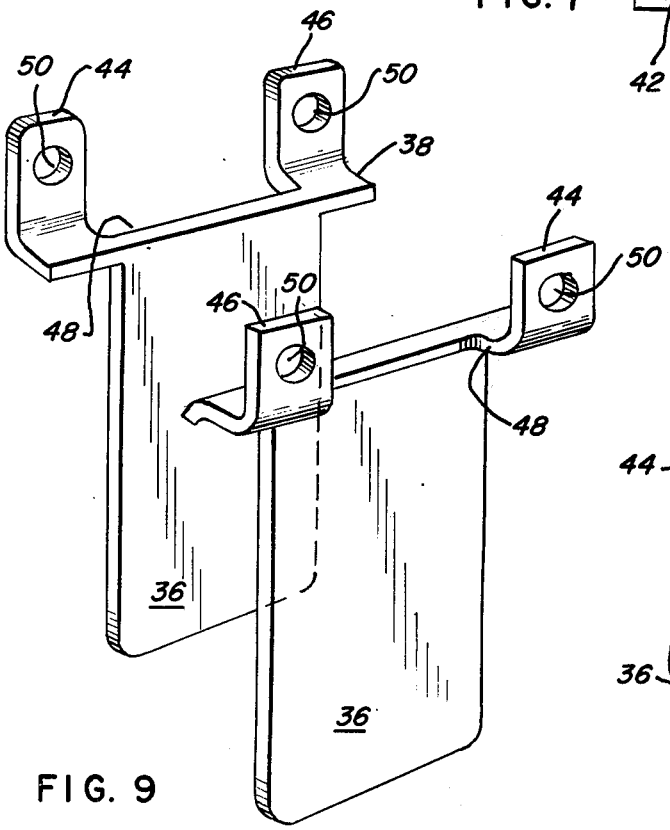
FIG. 9
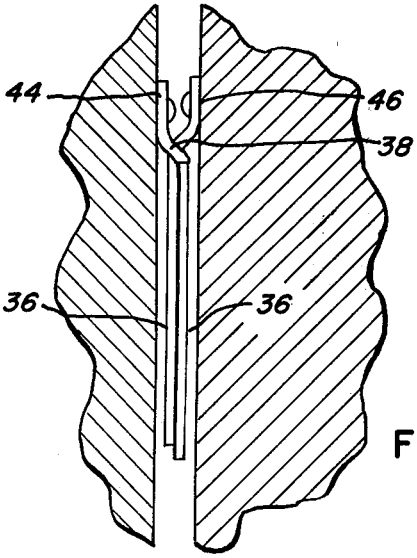
FIG. 10

FIG. 11
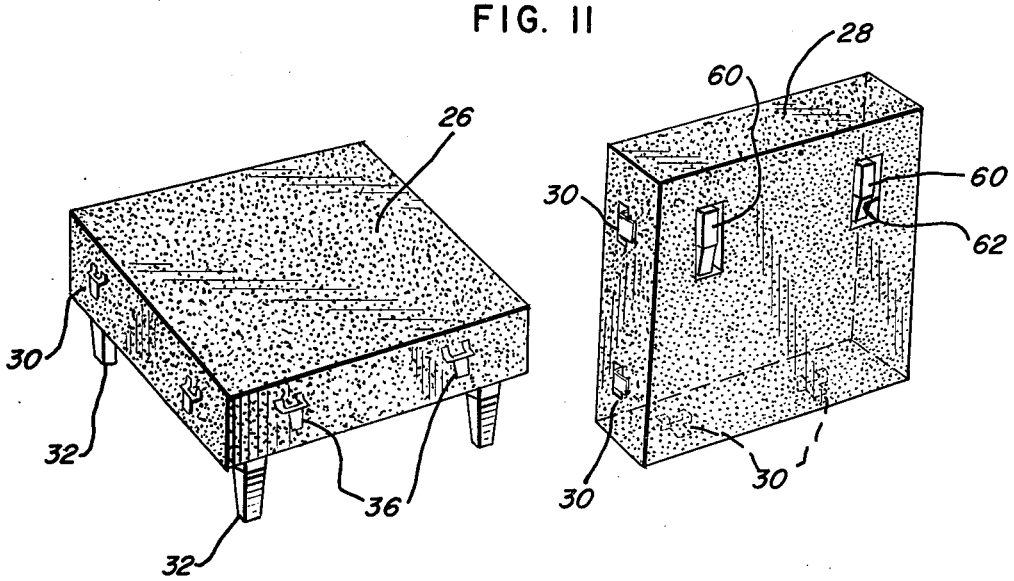
FIG. 12
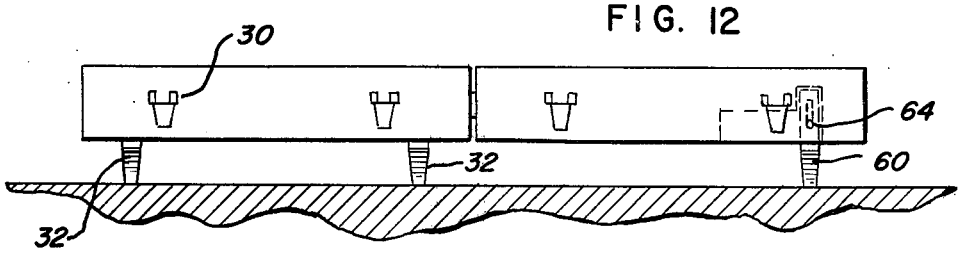
FIG. 13
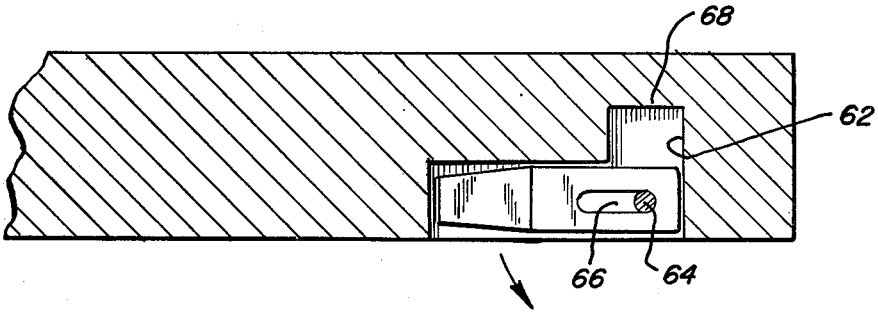
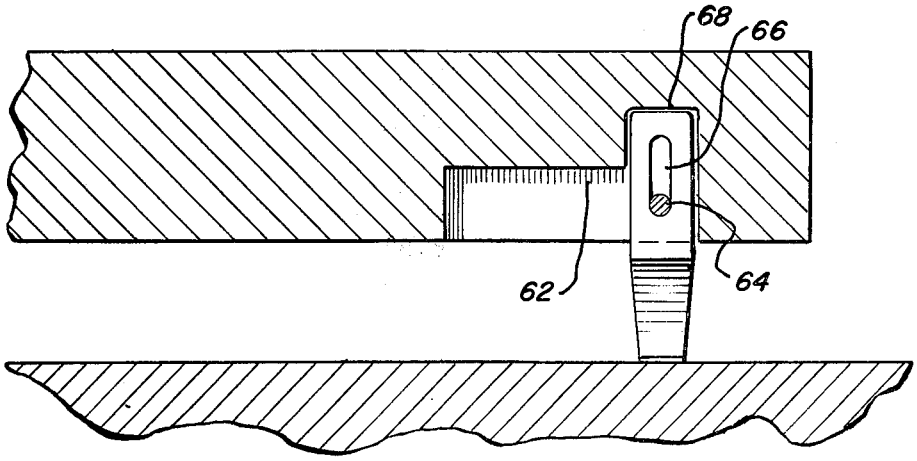
FIG. 14

MODULAR FURNITURE UNITS

BACKGROUND OF THE INVENTION

1. Field of the Invention

This invention relates to modular furniture units and the quick and easy assembly and disassembly thereof and to a system for such assembly and disassembly.

2. Brief Description of the Prior Art

In a preliminary patentability search conducted after the fact of the present invention, the following references were found: U.S. Pat. Nos. 2,164,715, 2,829,707, 3,316,018, 3,578,385 and 3,811,728. These patents demonstrate that it is generally known to construct knock-down furniture. However, prior art patents describe structures that are either not truly modular or else involve complicated or overly difficult assembly and/or disassembly procedures and, in most cases, involve the use of movable connection or assembly parts.

SUMMARY OF THE INVENTION

The present invention provides a modular furniture structure and construction which eliminates the difficulties in assembly and disassembly and eliminates the moving parts required by the prior art. The modular pieces are assembled using interconnectable hooking devices of unitary structure having nonmoving parts or elements, each of which has a female portion and a male portion for interconnecting the devices, without permanently affixing to each other. For example, in one form in which the modular pieces include arm rests and one or more seat and backrest pieces, the arm members rest upon the supporting floor surface and the seat and back members interconnect by insertion of male portions into the female receivers of the hooking devices on the arm portions. Multiple seat members, where used, interconnect with each other as do multiple back members. Support legs may be provided under the seat members in multiple modular units such as sofas or divans where desired or needed. Where a chair is intended to be convertible into a divan by realigning, abutting and reinterconnecting the backrest with the seat, extendable legs or other suitable support can be provided for the backrest member which becomes an extension of the seat.

While this invention is susceptible of embodiment in many different forms, there is shown in the drawings and will herein be described in detail certain specific forms thereof, with the understanding that the present disclosure is to be considered as an exemplification of the principles of the invention and is not intended to limit the invention to the embodiments illustrated.

BRIEF DESCRIPTION OF THE DRAWINGS

FIG. 1 is a perspective view of an assembled chair in accordance with the present invention;

FIG. 2 is an exploded view of the chair in FIG. 1 showing the alignment of hooking elements;

FIG. 3 is a perspective view of a sectional sofa assembled using the hooking elements in accordance with the present invention;

FIG. 4 is a perspective view of a one section sofa with much the same construction as a chair in FIG. 1 and FIG. 2;

FIG. 5 is a fragmentary top plan view of a sofa assembled in accordance with the present invention showing a curved central portion;

FIG. 6 is a fragmentary top plan view of an assembly of sectional furniture in which two sofa positions are fastened to a corner table portion using the hooking devices of the present invention;

FIG. 7 is a front plan view of one form of the hooking device used in the present invention;

FIG. 8 is a section through the hooking device of FIG. 7 taken along line 8—8 of FIG. 7;

FIG. 9 is a perspective view of a pair of hooking devices illustrating the preferred form used in the present invention;

FIG. 10 is a side view of interconnected modular portions of a furniture unit showing the interconnected position of the hooking devices of FIG. 9;

FIG. 11 is an exploded rear view of a seat member and a backrest member illustrating another form of the present invention;

FIG. 12 is a side view of the members shown in FIG. 11 reassembled in the form of a divan.

FIG. 13 is an enlarged sectional view showing the foldable legs of the device as seen in FIG. 11; and FIG. 14 is an enlarged section showing the legs unfolded as seen in FIG. 12.

DESCRIPTION OF THE PREFERRED EMBODIMENT

Referring first to FIGS. 1 and 2, there is illustrated a piece of knock-down furniture in accordance with the present invention in the form of an arm chair. The chair includes two arm sections 22 and 24, each in the form of a rectangular box-like structure. A cushioned seat 26 and a cushioned back 28 are also provided. In the exploded view of FIG. 2, it will be seen that the arms, seat and back are all provided with interengageable hooking devices 30. The hooking devices interengage, with the male portions on the devices 30 of the seat 26 and the back 28 received by downward movement into the female portions of the hooking devices 30 on arms 22 and 24 so that the entire chair is assembled and supported by the arm sections 22 and 24.

FIG. 3 illustrates a modular knock-down construction in which a plurality of seat members 26 and back members 28 are provided between two end or arm members 22 and 24. The three seat members 26 are interconnected with each other using the hooking devices 30 shown in FIG. 2. Likewise, the three back members 28 are interconnected using the hooking devices. In FIG. 3, the support legs 32 are provided on the bottom of the seat members 26 to prevent or minimize any possible sagging due to play between the hooking devices 30 and to prevent or minimize any hook breakage due to overstressing.

FIG. 4 shows a one-section sofa assembled in the same manner as the armchair in FIG. 1. Since the seat 26 and back portion 28 are each of one-piece construction, no supplemental support is likely to be needed from intermediate legs or the like, depending on the strength of the seat construction.

FIG. 5 shows another form of furniture assembly of the present invention with a plurality of interhooking seat portions or members 26 and interhooked back portions or members 28, using the hooking devices of the present invention.

FIG. 6 shows still another form including an end table 34 joined to abutting seat portions 26 using the hooking devices. Also, again, interhooked backrest members 28 are provided. In the units shown in FIGS. 5 and 6, leg members such as shown at 32 in FIG. 3 may be used if desired or needed. Whenever legs are used in the modular furniture of this invention, it is preferred that they be of the removable and adjustable type. Such legs are common, e.g. screw-in type legs which are removable and have screw level adjusters for levelling furniture. Removability of the legs makes the seat units more easily stackable in less space for storage, moving and/or shipping, while eliminating the need to rely on the arm members for support. The height adjustability aids in minimizing the stress which might otherwise be put on the hooking devices due to an uneven floor or the like.

Referring now to FIGS. 7 and 8 of the drawings, there is shown one form of a fastening or hooking device provided by the present invention. The device is a one piece integral metallic member. It may be coated with plastic if desired or even made of a strong plastic for use in areas where the humidity or atmosphere might be excessively corrosive to metallic members. The device includes as its male portion a tongue or breastplate element 36. Element 36 is integral with a ledge element 38 which offsets an integral faceplate 40 having bores 41 for use in securing the device to a furniture module by screws, bolts or the like. The use of screws or bolts in mounting the hooking devices on the various furniture members makes them easily replaceable in case of damage or breakage.

In the ledge element 38, there is provided a female portion in the form of groove or receiver 42 for receiving the breastplate of an identical hooking device to interconnect the two. A most useful feature of the present hooking devices is the quickness and ease with which one can connect and/or disconnect them. By a simple downward sliding movement with hooking devices on the seat and backrest aligned with those on the armrests or arm portions of a particular piece of furniture, the furniture can be readily assembled.

It will be noted that the tongue or breastplate element 36 is somewhat tapered near the bottom end thereof for guiding and easier insertion into the receiver 42 of another hooking device 30. Further, the corner where the edges of the breast element 36 merge into the bottom of ledge element 38 form fairly sharp 90° angles so that the breastplate element 36 can be inserted all the way into the receiver 42 and the ledge element 33 of one hooking device will lie flat and flush upon the ledge element 38 of another hooking device upon interconnecting as described above. The ledge elements 38 should be of sufficient lateral extent to prevent or minimize lateral rocking of the hooking devices relative to each other. It will also be noted that the breastplates 36 of two hooking devices lie against each other when the devices are interconnected and these breastplate elements should be of sufficient downward extent to minimize face to face rocking of the hooking devices relative to each other. The breastplates should also be of sufficient length and thickness to minimize breakage from overstressing in normal usage: i.e., pushing or pulling a furniture piece or sitting on a couch arm.

Where additional seat or back portions are desired for expansion purposes, it is obvious they likewise can easily be assembled into the unit such as in FIG. 3. Moreover, the furniture is also easily disassembled merely by disengaging the sliding hooking devices with the male portions simply sliding upwardly and thus disengaging the openings or receivers so that the furniture pieces can be stacked in a more compact manner for ease of handling, transportation or storage.

FIG. 9 shows another form of the hooking device of the present invention. In this form the offset faceplate 40 is cut away to form a portion of the slot 48, leaving two upstanding ears 44 and 46 having the mounting bores 50. The remainder of the device is the same as described with respect to FIGS. 7 and 8.

As best seen in FIGS. 9 and 10, the hooking devices are interchangeable with each being capable of having its male portion or breastplate 36 insertable within the female portion or slot 48 of the other. Thus, only one type of hooking device need be produced for any combination or assembly of furniture elements to produce a furniture unit.

Turning now to FIGS. 11 through 14, a modification of the present invention is shown. The unit illustrated consists of a seat member 26 and backrest 28 much the same as shown in FIG. 2. The arm rest elements are not illustrated in this modification although it will readily be seen that they can be used to interconnect the seat 26 and backrest 28 in the form of a chair. Instead, for support, removable legs 32 are provided as described above on the bottom of seat member 26. It will be noted that a pair of additional hooking devices 30 is provided on the back of the seat 26 and an additional pair is also provided on the bottom of backrest 28.

Also provided on the back of the backrest are a pair of legs 60 and receivers 62 for receiving the legs when the backrest is being used as part of a divan. Each leg 60 has a slot 66, pivotally mounting the leg 60 on a pin 64 which is secured at its opposite ends in the sidewalls of receiver 62.

In order to convert the chair elements of FIGS. 11 through 14 to a divan, the hooking devices 30 on the bottom of the backrest 28 are inserted into the receivers of the devices 30 on the back of the seat portion 26 to interconnect as described above. The legs 60 swing downward out of their receivers 62 about pins 64 to the position shown in FIGS. 12 and 14. Note that each receiver 62 is provided with an upward extension 68 for receiving the butt end of the leg 60 as leg 60 slides upward, permitted by the length of slot 66. The receiver 68 is of a size in close conformity with the butt or upper end of the leg 60 and holds the leg 60 fairly rigid and against collapse. Obviously other systems for rigidifying the legs can be provided. In fact, the pivotal legs are not necessary to form the divan since screw receivers can be provided on the back of the backrest 28 for receiving screw-in legs as described above.

Also, two or more divans can be assembled and placed so as to abut each other head to toe and/or side by side to provide a larger sleeping area where desired.

The component parts provided by the present invention can be interchanged between various units so that, to suit a certain occasion, the user is presented with a wide latitude of variations. For example, even as few as three seat and back units of a chair size and two end or arm supporting units can be arranged to provide either a chair or a two or three seat sofa. With additional end units and seat and back units, the possible combinations can become practically infinite. Also, units not in use at a particular time can be stacked conveniently and stored in a relatively small storage space. Thus, the present invention becomes useful not only for home use, but for institutional use where at a given time a number of people may need to be seated individually whereas at another time perhaps a few sofas will suffice.

It will be seen from the foregoing that this invention provides modular knock-down type furniture which can be quickly and easily assembled and disassembled and in which each modular unit is also of the knock-down type. Permanent or semipermanent fasteners such as screws, bolts, etc. are not used to directly connect the modules or members of the sections to each other. Such fasteners are only used to fasten the hooking devices to their respective modules or members. The hooking devices are connectable and interchangeable and yet offer much lateral stability and impart solidness to the assembled piece of furniture. Although more than one set of hooking devices is usually needed between modules of a section and between sections for good stability, the hooking devices of this invention permit the use of as few possible such devices in order to minimize cost and facilitate assembly and disassembly while still imparting stability.

I claim:

1. A non-locking knock-down furniture assembly which is quick and easy to assemble and disassemble by mere manual vertical movement of furniture parts comprising opposing upstanding members, each having inwardly facing hooking devices, a seat member and a back member each having outwardly facing hooking devices for vertically slidable and releasable non-locking engagement with the inwardly facing hooking devices of said members, each of said hooking devices being individually integral and identical to each other, each comprising a vertically depending breastplate element and a ledge element extending horizontally therefrom and having a receiver for vertically receiving the breastplate element of the other identical hooking device and supporting the other hooking device by planar facial engagement of the hooking device ledge elements.

2. The assembly of claim 1, wherein said assembly is a multi-section couch including a plurality of seat members and leg members on each of the seat members for supporting the seat members from the same surface as supports the support members.

3. The assembly of claim 1, wherein at least one of said upstanding members is a chair arm for resting on a support surface and supporting said seat and back members.

4. The assembly of claim 1 wherein at least one of said upstanding members is a corner or end table.

5. The assembly of claim 1 wherein each of said hooking devices comprises mounting plate means offset from and connected by the ledge element to said breastplate element.

6. The assembly of claim 5 wherein the receiver is a slot in said ledge element.

7. The assembly of claim 1 wherein each of said hooking devices includes a pair of upstanding ears defining a void therebetween, said ears being offset from but connected integrally with the breastplate by the ledge element, said ledge element having a slot defining the receiver with its ends defined by the inner surfaces of said ears and communicating with the void between said ears, each of said ear elements having a bore for receiving a screw or bolt to secure said device to the module of furniture on which it is mounted.

8. A method of assembling knock-down furniture by quick and easy vertical movement of furniture parts relative to each other, said knock-down furniture having arm, seat and back members which comprises providing parts or modules of the furniture with identical hooking elements, each having facing hooking devices for facing the hooking device of another module for vertical slidable and freely releasable non-locking engagement with the other hooking device, each of said hooking devices being individually integral and identical to each other, each comprising a vertically depending breastplate element and a receiver for receiving and supporting another hooking device by its breastplate element, and inserting the male portions of the hooking devices in the receivers of facing hooking devices so as to support the seat and back members from the arm members.

9. A hooking device for vertically slidable and releasable engagement with another identical hooking device, each of said hooking devices being individually integral and comprising a vertically depending breastplate element depending from a shoulder and ledge element, a receiver for receiving the breastplate element of the other hooking device and supporting the same, and a faceplate element upstanding from said ledge element.

10. The hooking device of claim 9 having a pair of opposing ears defining a void therebetween, said ears being offset from but connected integrally with the breastplate by the ledge element, said ledge element having a slot with its ends approximately defined by the inner surfaces of said ears and communicating with the void between said ears, or contiguous material of the device each of said ear elements having a bore for receiving a screw or bolt to secure said device to a vertical surface.

11. A non-locking knockdown furniture assembly having a plurality of separate sections which may be quickly and easily assembled and/or disassembled by a mere manual vertical movement of the sections relative to each other, each of said sections having a plurality of identical one piece unitary integral interchangeable hooking elements facing toward an identical hooking element of another section, said hooking elements each having no moving parts and comprising a vertically depending breastplate element and a ledge element extending horizontally from said breastplate element and having a receiver for vertically slidably receiving the breastplate element of another of the identical hooking devices in non-locking engagement and supporting the other hooking device by planar facial engagement of the other hooking device element.

* * * * *